United States Patent [19]

Nijhawan et al.

[11] 4,257,849

[45] Mar. 24, 1981

[54] COKE GUIDE FUMES CONTROL SYSTEM

[75] Inventors: Pramodh Nijhawan, Indianapolis; Joseph M. Duckworth, Zionsville, both of Ind.

[73] Assignee: Envirotech Corporation, Menlo Park, Calif.

[21] Appl. No.: 19,651

[22] Filed: Mar. 12, 1979

[51] Int. Cl.[3] ..... C10B 39/02

[52] U.S. Cl. ..... 202/228; 202/263

[58] Field of Search ..... 202/262, 263, 228

[56] References Cited

U.S. PATENT DOCUMENTS

| | | | |
|---|---|---|---|
| 3,928,144 | 12/1975 | Jakimowicz | 202/263 |
| 3,933,595 | 1/1976 | Gordon et al. | 202/263 |
| 3,966,563 | 6/1976 | Armour et al. | 202/228 |
| 4,142,942 | 3/1979 | Calderon | 202/263 |

FOREIGN PATENT DOCUMENTS

| | | | |
|---|---|---|---|
| 2326630 | 12/1974 | Fed. Rep. of Germany | 202/263 |
| 2717005 | 10/1978 | Fed. Rep. of Germany | 202/263 |

*Primary Examiner*—Norman Yudkoff

*Attorney, Agent, or Firm*—Robert E. Krebs; Thomas S. MacDonald

[57] ABSTRACT

A coke guide fumes control system includes a hood overlying a coke guide and apparatus for continuously evacuating the hood during a coke pushing operation. Several types of apparatus are illustrated. Some types are self-contained, including blowers and filter mechanisms mounted on the coke guide hood. The fumes and dusts from the pushing operation are evacuated through the filter mechanism under suction established by the blower, and the purified air pulled through the blower is exhausted to atmosphere. Alternatively, the hood can include slot-like nozzles cooperating with the blower to generate an air curtain which is directed down the sides of the coke guide to prevent the escape of contaminants through openings typically provided in the sides of such coke guide. Alternatively, and/or additionally, air curtains can be directed at the coke oven door opening to prevent the escape of contaminant fumes and dusts from the space defined by the coke oven door opening, the coke oven buckstays and the coke guide hood.

3 Claims, 7 Drawing Figures

COKE GUIDE FUMES CONTROL SYSTEM

This is a related application to the co-pending applications of the same inventors, assigned to the same assignee as the instant application, filed of even date herewith (i.e. Mar. 12, 1979), and having the following U.S. Ser. Nos.: 019,650; 019,434; 019,464 and 019,440.

This invention relates to pollution control, and primarily to a close-capture system for containing airborne contaminants such as those generated during a coke pushing operation in an oven of a coke oven battery.

Many industrial operations, such as coke pushing operations, generate large quantities of pollutant fumes and dusts. In a coke pushing operation, coke is pushed from a selected oven of a coke oven battery by a large ram through an oven door opening on one side (the so-called coke side) of the oven, through a coke guide and into a receptacle or conveyor, illustratively a so-called quench car or hot car. The hot, usually incandescent coke is transported in this receptacle or conveyor to a quench station, which may take the form of a quench tower or quench bath, in which the coke is drenched or submerged.

Several systems for capturing pollutants generated during transfer of the coke from the oven to the quench station are known. In some systems, such as those described in U.S. Pat. Nos. 3,630,852 and 4,050,992, the entire coke side of the battery, or a substantial portion of it, is enclosed in a shed all the way down to the wharf upon which quenched coke is dumped. The entire shed is continuously or intermittently evacuated, illustratively through an overhead duct system which draws an enormous volume of pollutant-laden air from the interior of the shed. Of course, an equally enormous blower and large capacity filter system must be provided to accommodate the large volume of pollutant-laden air withdrawn from the shed interior.

The expense of such a system is evident. First, coke oven batteries typically are quite large. Thus, the shed itself must be quite large. Since there is no way of controlling the dispersal of pollutant dust and fumes within the interior of the shed, the ventilation system must be able to withdraw completely the entire volume of air within the shed over a predetermined, relatively brief span of time. Thus, in addition to the high cost of constructing the large shed on the coke side of the battery, a high-capacity ventilation system, typically including large inlet ducts, large blowers and high-capacity filter mechanisms (such as precipitators, scrubbers or bag houses) must be provided.

In other alternative systems, such as that illustrated in U.S. Pat. No. 4,029,551, a large hood carried by the coke guide-supporting car is connected through a flexible duct system of the general duct-and-car type illustrated in U.S. Pat. No. 4,069,108, for continuous or intermittent evacuation. Of course, in a system of that type, the coke guide-supporting car must travel to the quench station with the quench car to insure that airborne pollutants released between the push and entry of the quench car into the quench station are captured.

In a third type of system, illustrated in U.S. Pat. No. 3,675,400 a separate car, riding upon the same rails as the quench car, supports, in cantilever fashion, a hood designed to overlie the entire length of the quench car when the separate car is close to the quench car, and progressively less of the quench car as the separate car moves away from the quench car. Of course, the separate car must also be flexibly connected to a continuous or intermittent evacuation system. Placement of the ventilation system-supporting car on the same tracks as the quench car is extremely inconvenient, since it does not permit the ventilation system-supporting car to pass the quench car.

In another prior art system, the coke guide is surmounted by a hood. A quench car hood is separately mounted for movement along a pair of vertically spaced tracks supported above, and adjacent, the quench car tracks. The coke guide hood is supported for movement along the coke side of the battery from an overhead track lying vertically above the coke guide locomotive tracks. A continuously ventilated duct-and-car arrangement, of the general type described in U.S. Pat. No. 4,069,108, is disposed laterally along the coke side, with the coke guide locomotive tracks, the overhead coke guide hood supporting track, the quench car tracks, and the quench car hood-supporting tracks and framework located between the coke side of the battery and the duct-and-car arrangement. Separate ducts connect the coke guide hood and quench car hood to the car of the duct-and-car arrangement. The conduit connecting the quench car hood to the car of the duct-and-car arrangement includes a regenerative heat exchanger.

Typically, the quench car hoods of coke oven installations are fairly massive. Thus, it will be appreciated that, in order to support the quench car hood in such cantilever fashion, the wheels on the quench car hood, the vertically spaced tracks engaged by such wheels, and the framework supporting such tracks must be of fairly heavy and strong construction. Additionally, a separate framework, equally as sturdy as the one supporting the quench car hood, is provided to support the duct of the duct-and-car arrangement well above the level of the quench car tracks and out of interference with the unloading operation from the quench car onto the wharf. A system of this last-described type is offered jointly by Hartung, Kuhn & Co. Maschinenfabrik GmbH, Dusseldorf, and Firma Carl Still, Recklinghausen, both of West Germany.

Yet another type of system is illustrated by British Patent Specification No. 1,310,980. In systems of this type, a collapsible hood expanded and contracted by a fluid motor is provided around the coke guide to collect dusts and fumes generated during the push. A duct-and-car arrangement is used to evacuate the collapsible hood. In this embodiment, the car is inside the duct, and the duct is supported above the coke guide locomotive on a suitable support frame. An apparent weakness of the systems of this type is that no separate hood mechanism is provided for close capture of contaminants released from hot coke in the quench car after the push. Therefore, to insure capture of such contaminants, the coke guide locomotive must always accompany the quench car. Further, the coke guide hood must be sufficiently long to cover the entire length of the quench car. In very many situations, such requirements for adequate ventilation make installations of this type prohibitively expensive.

According to the invention, a contaminant capture system for a coke oven pushing operation includes suction means, and a duct extending along the coke oven battery and coupled to the suction means for evacuation. The duct includes a wall portion closed by a flexible web. A car is disposed for movement along the duct to raise the web to couple the interior of the car to the interior of the duct. A mobile first hood, and means for coupling the first hood to the car and for moving the car to dispose the first hood in overlying relation to a selected portion of a conveyor for incandescent coke are provided. This apparatus permits withdrawal into the first hood means of contaminants evolved as the incandescent coke is conveyed, for example, to a quenching station. The system further includes a mobile second hood mounted on the coke guide through which the incandescent coke is pushed from the oven. The mobile second hood is provided to withdraw contaminants evolved as the coke is pushed from the oven to the conveyor. The second hood includes blower means, means for forming an air curtain and for directing the air curtain to contain and prevent the escape of contaminants evolved during the push, and means for connecting the air curtain-forming means to the blower means.

Illustratively, the air curtain-forming and directing means can comprise means for directing the air curtain toward the coke oven door opening edges, for directing the air curtain along the direction of movement of the coke as the coke exits from the coke guide, or in the case of slatted coke guide side walls, means for directing the air curtain along the coke guide side walls to contain evolved contaminants against escape through the slatted coke guide side walls to atmosphere.

Further according to the invention, the blower means includes means defining a suction inlet within the second hood and filter means disposed between the inlet and the air curtain-forming means. This arrangement permits filtering of the evolved contaminants from the air stream provided by the blower means, such that the filtered air stream can be used to form the air cutrain.

Additionally, according to the invention, a second duct can be provided for coupling the second hood to the car. In this manner, contaminants in the interior of the second hood are evacuated cooperatively through the blower inlet and the first duct.

According to the invention, for a coke guide means having two opposed side walls, a bar or plate is provided which extends between, and is attached to, the two side walls at the height at which the coke is exhausted from the guide means. The coke strikes the bar or plate and is broken into suitably sized lumps.

Further according to the invention, the coke guide means includes a surrounding coke guide hood, and means for projecting and retracting the coke guide hood respectively toward and away from the walls of a selected coke oven. Alternatively, or additionally, the projecting and retracting means can be provided to project and retract the second hood means respectively toward and away from the mobile first hood.

The invention may best be understood by referring to the following description and accompanying drawings which illustrate the invention. In the drawings.

Figure 1:
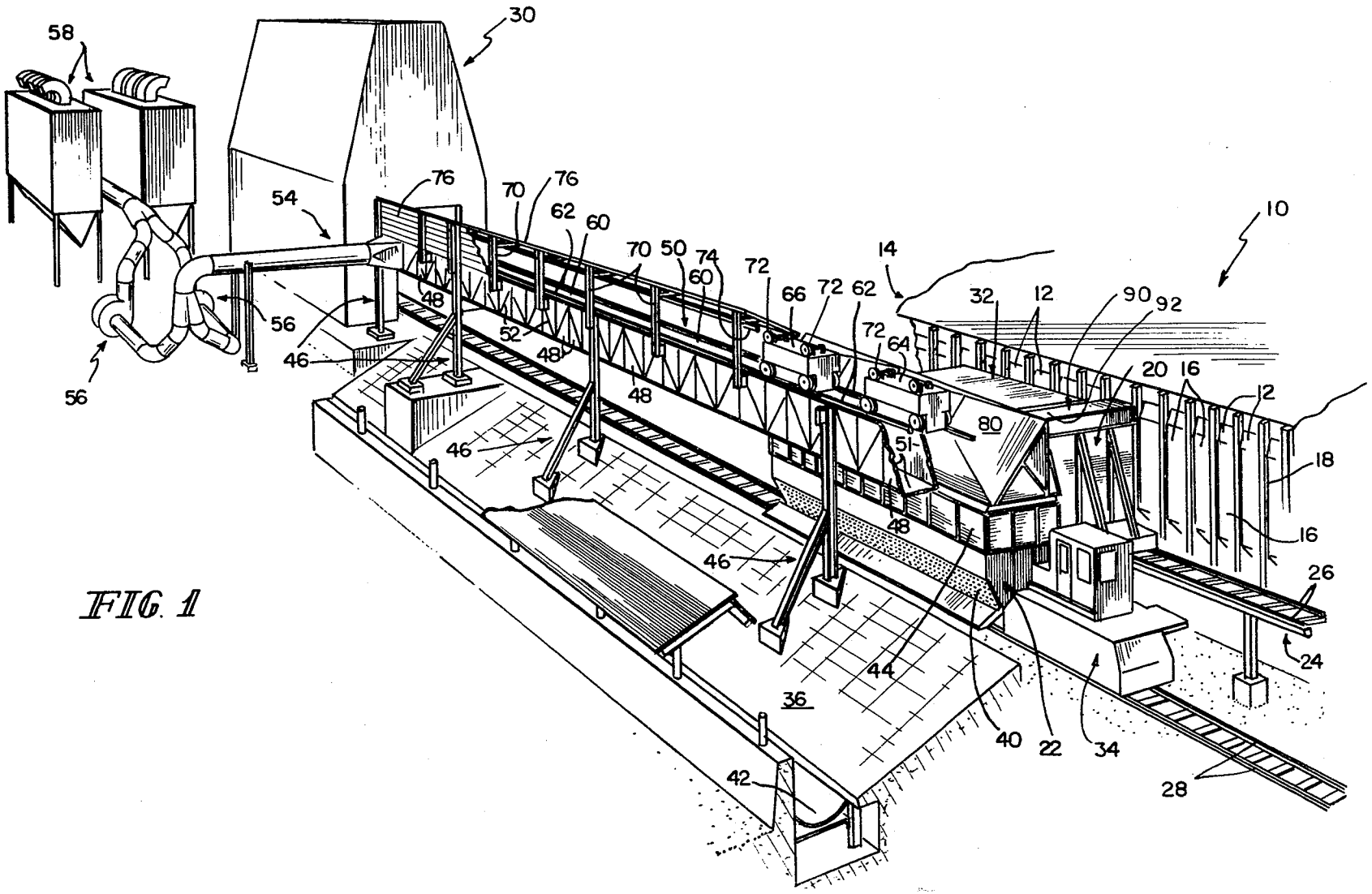
FIG. 1 is a partly fragmentary perspective view of a typical coke oven battery installation, with the close-capture contaminant control system of the instant invention installed.
Figure 2:
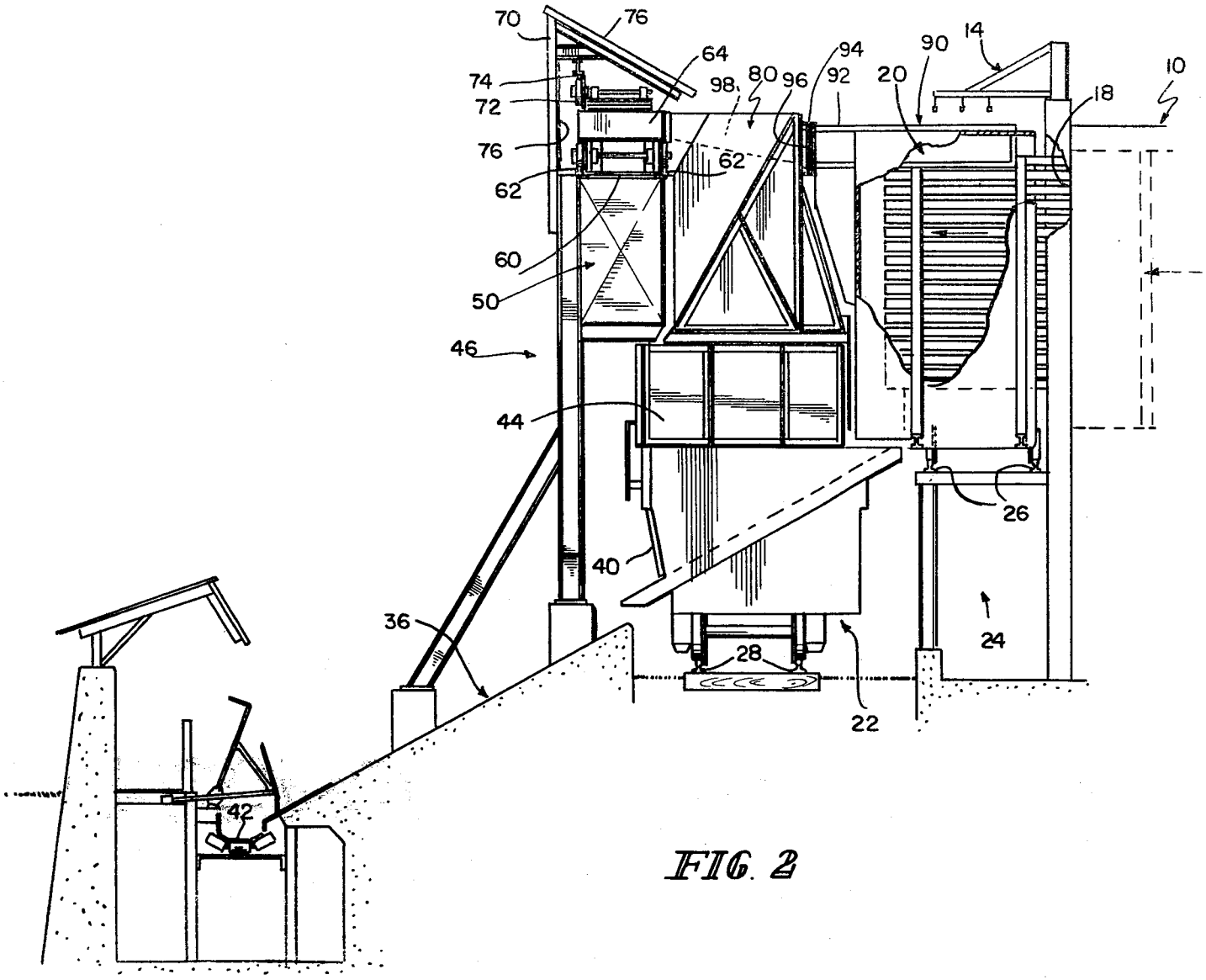
FIG. 2 is a partly fragmentary end elevational view of the installation of FIG. 1.

Referring now particularly to FIGS. 1–2, a coke oven battery 10 consists of several coke ovens 12 in parallel. Each oven 12 is provided at its coke side end 14 with a door 16, and at its push side end (not shown) with a ram for pushing coke through the oven from the ram side to the coke side 14 to empty the oven. The oven 12 is emptied through its door opening 18 and a coke guide 20 into a waiting quench car 22. The coke guide 20 is movable along a master gallery 24 on railroad-type rails 26 to align it with a selected oven 12 to be emptied. Similarly, the quench car 22 is movable along the coke side 14 of the oven battery 10 to receive the coke pushed through the guide 20. The quench car 22 is movable on railroad-type rails 28 which extend along the coke side and to a quenching station 30, illustratively, a quenching tower. The means for moving the coke guide 20 to a selected oven 12 is a door machine locomotive 32 movable on rails 26. This machine 32 incorporates the function of supporting and moving the coke guide with the function of removing the door 16 from the selected oven 12 and replacing the door after a push is completed. The quench car 22 is moved by a locomotive 34 mounted on the rails 28.

An unloading wharf 36 is provided adjacent the rails 28 to permit quenched coke from station 30 to be unloaded through a door 40 on quench car 22 and gravity-fed to a continuous coke conveyor belt 42. Coke conveyor belt 42 transfers the finished coke to a storage area. The door 40 is perforated to permit the water used to quench the coke in car 22 to drain from the car 22. A quench car 22 also includes extended side walls 44 which increase the vertical height of the quench car 22 up to the vertical height of the top of the locomotive 34.

The ventilation, or pollution evacuation, system for the pushing operation includes a longitudinally spaced series of support posts or pillars 46 anchored in the wharf 36 adjacent rails 28. Each pillar 46 supports a longitudinally extending section 48 of a first duct 50. Each section 48 includes its own supporting framework 52 which cooperates with a respective pillar 46 to make each section 48 generally self-supporting. Each section 48 is coupled in sliding, substantially air-tight sealing engagement with its adjacent duct sections 48. This sectional arrangement permits relatively unimpaired thermal variations in the length of each section 48 without adversely affecting the total length of the duct 50. Transition and connector duct sections 54 at one end of the first duct 50 couple the interior of duct 50 through suction means 56 to an assembly, such as a bag house, fume scrubber or separator 58. Dust and fumes from the hot coke are separated at station 58 and clean air exhausted to atmosphere.

The duct 50 is generally rectangular in transverse section, and includes three rigid walls 51 supported in the framework 52, and an upper wall section which is closed by a flexible web or belt 60. The vertically upper edges of the vertically extending wall of duct 50 are provided with rails or tracks 62 supporting substantially identical, belt-lifting first and second cars 64, 66 for movement along duct 50. The operation of the cars 64, 66 on duct 50 is generally as described in U.S. Pat. Nos. 2,923,227, 3,478,668, 3,481,265, 3,698,137, 3,705,545, 3,788,208, and 4,086,847, as well as the above-identified British patent specification No. 1,310,980, and U.S. Pat. Nos. 4,029,551 and 4,069,108.

Vertically extending supports 70 are attached to the framework 52 so as to avoid interference with movement of the cars 64, 66 along tracks 62. Each car 64, 66 includes a pair of upper wheels 72. Supports 70 support a track 74 which is engaged by wheels 72 of each car. Supports 70 also support a pent roof 76 which protects wheels 72, tracks 74 and the web or belt 60 from weather.

The contaminant capture system includes a first, mobile hood 80. The coke guide 20 is surmounted by a second mobile hood 90. Hood 90 is coupled to a second duct 92 which terminates at a flange 94 adjacent hood 80. Hood 80 is provided with a mating flange 96. A third connecting duct 98 is provided internally of hood 80. Hood 80 is supported from the cars 64, 66. Hood 80 is evacuated into the duct 50 through openings in cars 64, 66. Hood 90 is evacuated through ducts 92, 98 and car 64 into duct 50.

Figure 3:
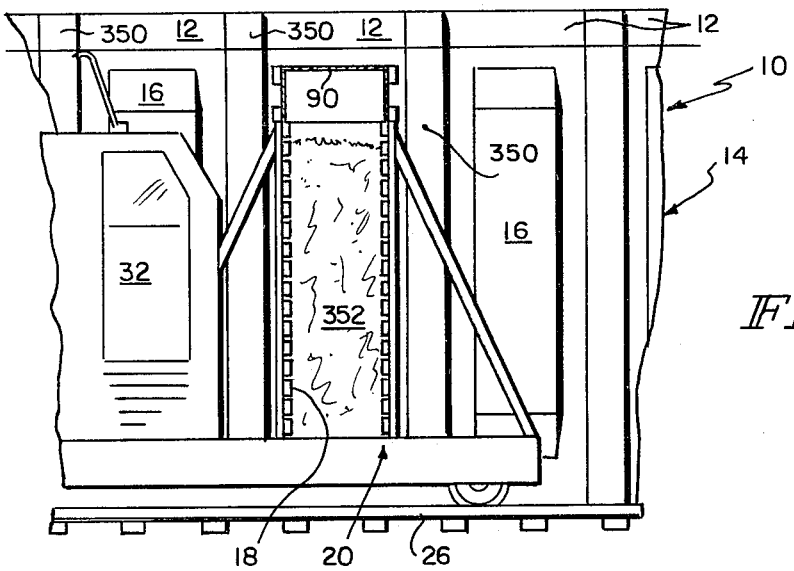
FIG. 3 is a fragmentary side elevational view of a detail of the installation of FIGS. 1–2, in operation.

FIG. 3, a fragmentary end elevation of the battery 10 from the coke side 14, shows in greater detail adjacent ovens 12, a selected one of which (12') is being emptied. For this purpose, the door 16 of oven 12' has been removed by the door machine 32, exposing the door opening 18 of oven 12'. The door machine locomotive 32 has been moved on rails 26 to place the coke guide 20 directly in front of the opening 18.

Here it should be noted that the guide 20 can be of a type which can be projected, or otherwise moved perpendicular to the longitudinal extent of rails 26. Alternatively, guide 20 can be the type which, when positioned along rails 26 by the locomotive 32, does not project toward the door opening 18 of the selected oven 12' between the oven battery 10 buckstays, or vertical supports, 350 which bracket each door opening 18. This latter type of guide 20 is generally referred to as a "stationary" guide, although it must be understood that all guides are moved longitudinally along the coke side 14 into alignment with the various ovens 12.

FIG. 3 illustrates a mass 352 of incandescent coke being pushed from the door opening 18 through the guide 20 toward the waiting quench car 22 (FIGS. 1–2). The evolved dusts and fumes captured under the hood 90 are evacuated through the duct 92, past flanges 94, 96, through the duct 98 internally of hood 80, and through the interior of car 64 into the main duct 50.

Figure 4:
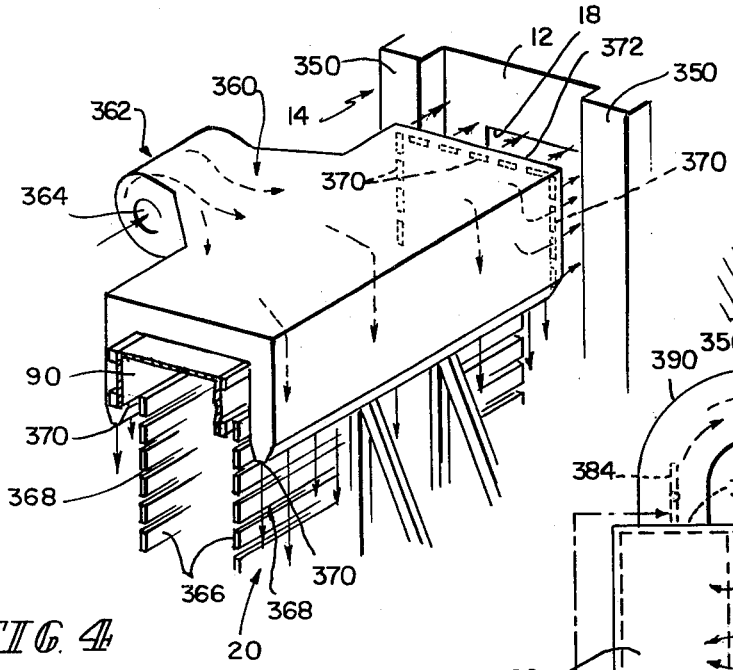
FIG. 4 is a fragmentary perspective view of an alternative detail of the installation of FIGS. 1–2.

In an alternative arrangement, illustrated in FIG. 4, the hood 90 overlies the guide 20, and a duct 92 (not shown) still couples the hood 90 through the duct 98 in hood 80 to the car 64. However, in the embodiment illustrated in FIG. 4, an air curtain-generator hood 360 has been added. Hood 360 overlies the hood 90. Hood 360 is provided with a blower 362 having an intake port 364 through which fresh air is drawn into the hood 360. The illustrated coke guide 20 is of a "slatted" type having side walls 366 provided with openings 368. This is a common type of guide 20.

To prevent the escape of contaminant dusts and fumes evolved during the push through the openings 368, hood 360 is provided with two downwardly directed elongated, slot-shaped air curtain generating nozzles 370. Nozzles 370 direct air provided by blower 362 at high velocity through the interior of hood 360 downwardly across the side walls 366 of guide 20. This continuous air curtain prevents the escape of such contaminant dusts and fumes through openings 368.

The illustrated guide 20 is of a "stationary" type, meaning that it does not project between the buckstays 350 into contact with the oven 12 sidewall adjacent door opening 18 during the push. Consequently, it is desirable to prevent, to the greatest extent possible, contaminant fumes and dusts from escaping from the space between the coke side end 14 of oven 12 and the adjacent surfaces 372 of hood 360. Thus, surfaces 372 are also provided with air curtain-generating nozzles 370 which direct clean air at high velocity and under pressure from blower 362 toward the coke side end 14 of oven 12 around the upper extent of door opening 18. The air curtain thus formed, along with the suction provided by hood 90 through duct 92, duct 98, car 64 and duct 50, minimizes the escaping contaminant dusts and fumes from between the oven and the air curtain generator hood 360.

Figure 5:
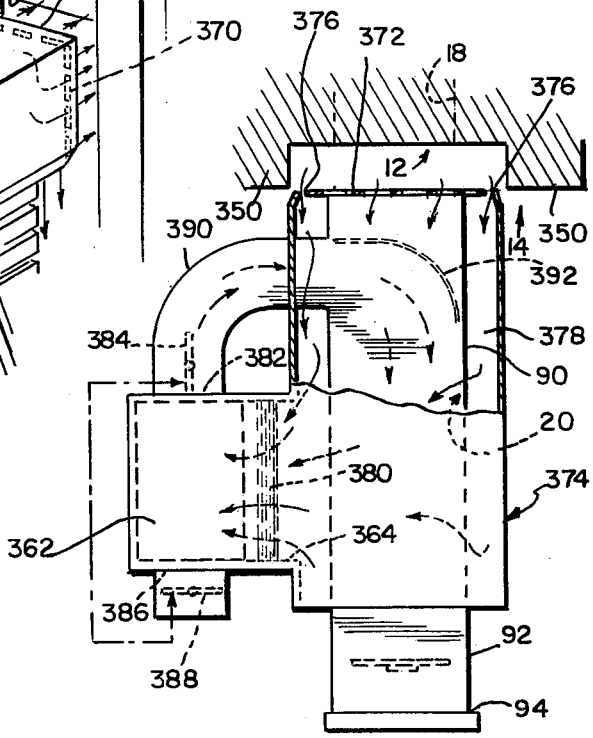
FIG. 5 is a fragmentary top plan view of an alternative detail of the installation of FIGS. 1–2.

The alternative system illustrated in FIG. 5 can be used in at least two different modes of operation. The guide 20 is surmounted by an auxillary ventilation hood 374. Space is provided under hood 374 for the hood 90 and duct 92 of the prior embodiments. However, it must be understood that ventilation hood 374 can be used either with or without the accompanying structure 90, 92, 94. Ventilation hood 374 includes intake ports 376 in surfaces 372 adjacent the coke side end 14 of oven 12. An internal shroud space 378 is established between hood 90 and the outer walls of hood 374. When no hood 90 is used, the entire interior of hood 374 is exposed directly to the hot coke moving through the guide 20. Hood 374 is provided with blower 362. A filtration apparatus 380, such as a stack of disposable filter elements, is positioned in the intake port 364 of blower 362. Blower 362 is provided with an exhaust port 382 controlled by a damper 384 and an exhaust port 386 controlled by a damper 388. Dampers 384, 388 are simultaneously controllable such that when one of them is fully opened, the other is fully closed.

When the system of FIG. 5 is used in conjunction with the hood 90, exhaust port 382 is coupled through a conduit 390, and the wall of hood 90 to the interior of the hood. In this embodiment, the hood 90 includes an internal baffle 392 above the level of the coke mass moving through the guide 20. The baffle 392 directs air from port 382 toward duct 92 for entry into the duct 50 through duct 98 in car 64. See FIG. 2. In the described mode, blower 362 thus acts as an auxillary ventilation system to the suction means 56 (FIG. 1).

In the alternative mode of operation of the apparatus of FIG. 5, hood 90 is deleted. Thus, all dusts and fumes evolved from the mass of coke moving through guide 20 are drawn through the filter stack 380 to remove the dusts and fumes from the flowing air stream. In this mode, damper 388 is opened and damper 384 is closed. The filtered air is exhausted directly from the blower 362 through port 386 to atmosphere.

Figure 6:
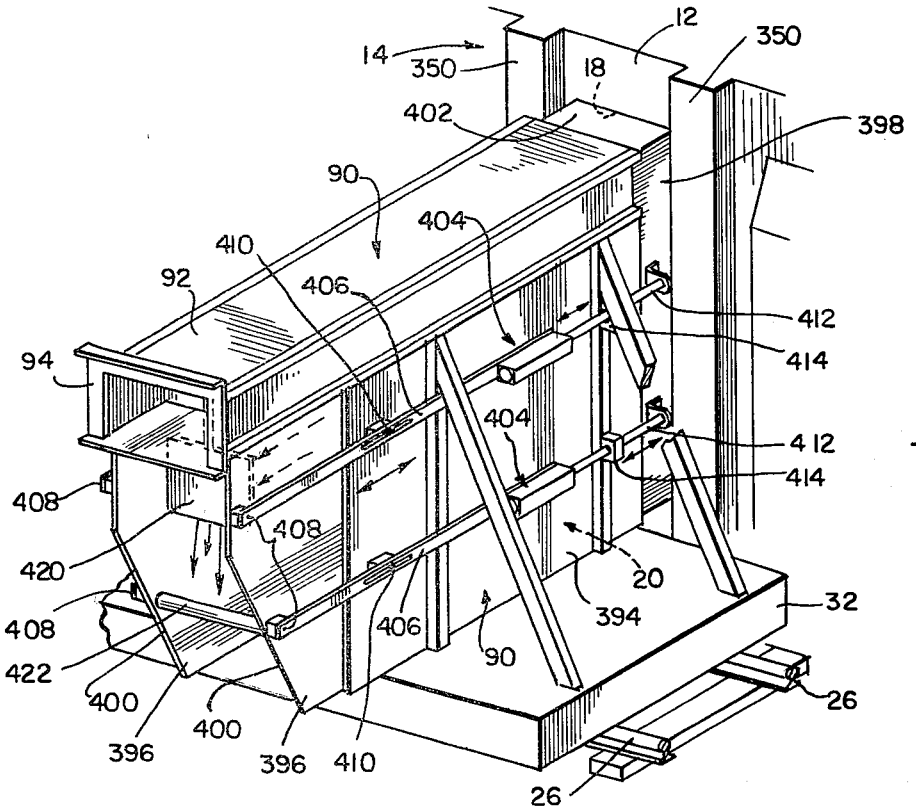
FIG. 6 is a fragmentary perspective view of an alternative detail of the installation of FIGS. 1–2.

In the embodiment of the apparatus illustrated in FIG. 6, the coke guide 20 is surrounded and closed by the overlying hood 90, which is connected through duct 92 to flange 94 for evacuation through the main exhaust duct 50 (FIGS. 1–2), stationary side wall 394, and movable side wall portions 396, 398. Side wall portions 396, 398 project generally transversely to the direction of motion of the door locomotive 32 on rails 26 along the coke side 14 of the battery 10. Side walls 396 are contoured at their outer edges 400 to fit closely the side wall contours of the hood 80 (see FIG. 2). This contour 400 helps minimize the escaping contaminants from a pushing operation.

The movable side wall portions 398, and a connecting top portion 402, form basically an extension of the hood 90. This extension is projectable between the buckstays 350 of a particular oven 12, and into closely spaced, surrounding relation with the door opening 18 of the oven 12 to prevent contaminant dusts and fumes from escaping from between the hood 90 and coke side end 14 of the oven 12. The projection of side wall portions 396, 398 is achieved through the use of pneumatic or hydraulic piston-and-cylinder arrangements 404 mounted on the stationary side wall 394. The mounting mechanism for each piston-and-cylinder arrangement 404 includes an arm 406 attached at 408 to movable side wall portions 396 near the contoured edges 400 thereof, and slidably reciprocably mounted at 410 from the stationary side walls 394 by means of an elongated slot aperture in the arm 406 and a pin mounted on the side wall 394 and projecting through the aperture. The piston rod 412 of each piston-and-cylinder arrangement 404 extends through a bearing block 414 on the supporting framework and is attached by means of a connecting link 416 to the movable side wall portion 398.

The projection and retraction of the movable side wall portions 396, 398 by actuation of the double-acting piston-and-cylinder arrangement 404 is thus "self-centering." That is, side wall portions 396, 398 are provided with sufficient travel that they abut positively the hood 80 contours and the oven 12 coke side contours. Of course, as previously mentioned, the coke guide 20 itself may be "stationary" or may, in fact, project with side wall portions 396, 398 toward the coke side end 14 and the quench car 22 (see FIGS. 1–2).

Figure 7:
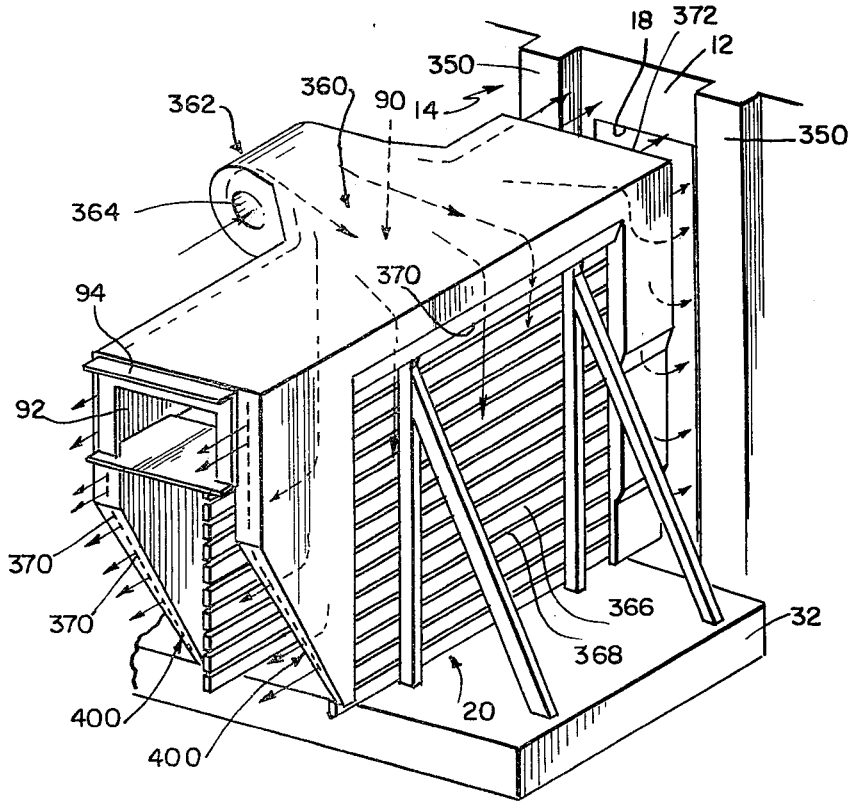
FIG. 7 is a fragmentary perspective view of an alternative detail of the installation of FIGS. 1–2.

In the embodiment of FIG. 7, the air curtain generator hood 360 is mounted over the hood 90, duct 92 and flange 94. The air curtain generator hood 360 in the embodiment of FIG. 7 is provided with nozzles 370 which direct air downwardly across the openings 368 in coke guide 20 side walls 366 to prevent contaminant dusts and fumes from escaping through these openings 368. Additional nozzles 370 are provided for vertically the full height of door openings 18. These nozzles 370 direct a surrounding and enclosing curtain of air toward the perimeter of door 18 to prevent dusts and fumes from escaping between the adjacent surface 372 of hood 360 and the coke side 14 of oven 12 between buckstays 350. A further full length set of air curtain generator nozzles 370 is provided along each of the contoured edges 400 of hood 360 to direct a surrounding and enclosing air curtain toward the hood 80 to prevent contaminant fumes and dusts from escaping between the contoured surfaces of hood 80 and the contoured edges 400 during the push.

As best illustrated in FIG. 6, the breaker mechanism which conventionally is supported from the coke guide, and extends out between the coke guide and quench car, can be provided on the movable side wall portion 396 of the close-capture hood. Typically, the breaker mechanism consists of a plate or bar suspended in the path of the incandescent coke as the coke is pushed through the guide. This breaker mechanism insures the break-up of the coke into smaller lumps. The illustrative breaker mechanism in FIG. 6 consists of both a plate 420 and a bar 422 attached to the side walls of movable side wall portion 396. Both the plate 420 and bar 422 are disposed in the path of the hot coke as it emerges from the oven 12, such that the hot coke strikes plate 420 and bar 422 and is broken up prior to falling into the quench car 22 (FIGS. 1–2).

What is claimed is:

1. A contaminant capture system for a coke oven pushing operation for a coke oven battery having a coke side provided with a coke guide movable along the battery for guiding coke from a selected oven of the battery during the push and a conveyor means movable along the battery to receive the coke pushed through the guide and convey it to a quenching station, the system including suction means, a first duct extending along the battery and coupled to the suction means for evacuation thereby, the first duct including a wall portion closed by a flexible web, a car disposed for movement along the duct to raise the web to couple the interior of the car to the interior of the duct, mobile first hood means, means for coupling the first hood means to the car, means for moving the car to dispose the first hood means in overlying relation to a selected portion of the conveyor means to draw into the first hood means contaminants evolved as hot coke is transported on said conveyor means, mobile second hood means mounted on the coke guide, a second duct for connecting said first hood means in flow communication with said second hood means, auxiliary ventilation hood means surmounting said second hood means such that an internal shroud space is established between said second hood means and said ventilation hood means, a conduit for connecting said ventilation hood means in flow communication with said second hood means; blower means inclusive of filtration means for withdrawing contaminated gases from said shroud space and delivering filtered gases to said first duct via said conduit, said second hood means, said second duct, said first hood and said car, respectively; means being provided with a first exhaust port controlled by a first damper and with a second exhaust port controlled by a second damper, said first exhaust port connected in flow communication with said conduit, said second exhaust port discharging to the atmosphere, said first and second dampers being simultaneously controllable such that when one of said dampers is fully opened, the other of said dampers is fully closed.

2. A contaminant capture system for a coke oven pushing operation for a coke oven battery having a coke side provided with a coke guide movable along the battery for guiding coke from a selected oven of the battery during the push and a conveyor means movable along the battery to receive the coke pushed through the guide and convey it to a quenching station, the system including suction means, a duct extending along the battery and coupled to the suction means for evacuation thereby, the duct including a wall portion closed by a flexible web, a car disposed for movement along the duct to raise the web to couple the interior of the car to the interior of the duct, mobile first hood means, means for coupling the first hood means to the car, means for moving the car to dispose the first hood means in overlying relation to a selected portion of the conveyor means to draw into the first hood means contaminants evolved as hot coke is transported on said conveyor means, and mobile second hood means surrounding the coke guide to draw into the second hood means contaminants evolved as hot coke is pushed from said selected oven to the conveyor means, said second hood means having stationary side walls and a movable extension which may be projected from said stationary side walls between the buckstays of the selected oven and into closely spaced surrounding relation with the door opening of the oven to prevent contaminant dust and fumes from escaping from between the second hood means and the coke side end of the oven; wherein said second hood means has a second movable extension associated therewith, said second extension located at the end of said second hood means opposite the selected oven; and comprising two opposed projectable side walls which are contoured at their outer edges to fit closely to the adjacent side wall contours of said first hood means; and striker means extending between said two opposed projectable side walls such that said striker is disposed in the path of the hot coke as it emerges from said selected oven.

3. The contaminant capture system of claim 2 wherein said movable extension is projected by double-acting hydraulic or pneumatic piston-and-cylinder arrangements connected at one end to the stationary side walls and at the other end to said movable extension.

* * * * *